US010755827B1

(12) United States Patent
Ryan et al.

(10) Patent No.: US 10,755,827 B1
(45) Date of Patent: Aug. 25, 2020

(54) RADIATION SHIELD

(71) Applicant: Northrop Grumman Systems Corporation, Falls Church, VA (US)

(72) Inventors: Vivian W. Ryan, Severn, MD (US); Sameh S. Wanis, Washington, DC (US); Carl B. Freidhoff, New Freedom, PA (US); Clinton Ung, Ellicott City, MD (US)

(73) Assignee: NORTHROP GRUMMAN SYSTEMS CORPORATION, Falls Church, VA (US)

( * ) Notice: Subject to any disclaimer, the term of this patent is extended or adjusted under 35 U.S.C. 154(b) by 0 days.

(21) Appl. No.: 16/415,300

(22) Filed: May 17, 2019

(51) Int. Cl.
*G21F 1/00* (2006.01)
*H01F 7/02* (2006.01)

(52) U.S. Cl.
CPC *G21F 1/00* (2013.01); *H01F 7/02* (2013.01)

(58) Field of Classification Search
CPC ..... G21F 1/00; H01F 7/02
USPC ..... 250/505.1, 506.1, 507.1, 515.1, 516.1, 250/517.1, 518.1, 519.1
See application file for complete search history.

(56) References Cited

U.S. PATENT DOCUMENTS 3,787,790 A 1/1974 Hull et al.
4,535,235 A 8/1985 McIver, Jr.
5,063,294 A 11/1991 Kawata et al.
5,386,115 A 1/1995 Freidhoff et al.
5,492,867 A 2/1996 Kotvas et al.
5,536,939 A 7/1996 Freidhoff et al.
5,723,862 A 3/1998 Forman
5,747,815 A 5/1998 Young et al.
6,107,628 A 8/2000 Smith et al.
6,583,426 B1 6/2003 Kawanami et al.
6,727,495 B2 4/2004 Li
7,057,170 B2 6/2006 Freidhoff
7,402,799 B2 7/2008 Freidhoff
7,459,693 B2 12/2008 Park et al.
7,767,959 B1 8/2010 Freidhoff
7,928,363 B2 4/2011 Bateman
8,324,565 B2 12/2012 Mordehai et al.
8,481,928 B2 7/2013 Franzen
8,946,625 B2 2/2015 Nikolaev et al.
9,721,777 B1 8/2017 Muntean
2004/0195503 A1 10/2004 Kim et al.
2005/0199805 A1 9/2005 Freidhoff
2010/0308218 A1 12/2010 Wang
2011/0012017 A1 1/2011 Nishiguchi
2011/0198516 A1* 8/2011 Fan ..... G21F 7/00 250/518.1

(Continued)

OTHER PUBLICATIONS

Goldberg, Genetic Algorithms in Search, Optimization & Machine Learning, Jan. 1989, 432 pages.

(Continued)

*Primary Examiner* — Nicole M Ippolito
(74) *Attorney, Agent, or Firm* — Edell, Shapiro & Finnan, LLC

(57) ABSTRACT

An apparatus for radiation shielding is provided. The apparatus includes a first housing element and a first plurality of magnetic elements arranged in a first array on the first housing element. The first array is configured to generate a first tapered magnetic field and, using the first tapered magnetic field, deflect incoming radiation away from a protected element.

20 Claims, 17 Drawing Sheets

(56) References Cited

U.S. PATENT DOCUMENTS

| | | | |
|---|---|---|---|
| 2012/0085869 | A1 | 4/2012 | Lloyd |
| 2013/0175441 | A1 | 7/2013 | Zanon |
| 2013/0187044 | A1 | 7/2013 | Ding |
| 2015/0206731 | A1 | 7/2015 | Zhang |
| 2015/0371839 | A1 | 12/2015 | Yasuno |
| 2016/0181080 | A1 | 6/2016 | Williams |
| 2016/0260594 | A1 | 9/2016 | Hendricks |
| 2018/0005812 | A1 | 1/2018 | Mavanur |
| 2019/0096644 | A1 | 3/2019 | Freidhoff et al. |

OTHER PUBLICATIONS

W.H. Press et al., Numerical Recipes: The Art of Scientific Computing, Third Edition, Cambridge Univ. Press, 2007, 1262 pages.
Deflector: Spatial Separation, downloaded from https://www.phys.ksu.edu/personal/sroland/Deflector.htm on Nov. 2, 2018 at 11:25:37 AM, 1 page.
D.L. Carroll's FORTRAN Genetic Algorithm Driver, http://cuaerospace.com/carroll/ga/ReadMe, Apr. 19, 2004 12:08:17 PM, 7 pages.
Kerry Cheung, et al., Chip-Scale Quadrupole Mass Filters for Portable Mass Spectrometry, Journal of Microelectromechanical Systems, Apr. 26, 2010, 15 pages.
Yiyuan Cheng et al., Simulation and Optimization of a Permanent Magnet for Small-sized MRI by Genetic Algorithm, Proceedings of the 2nd International Conference on Systems Engineering and Modeling (ICSEM-13), Published by Atlantis Press, Paris, France, 2013, 4 pages.
Garrett H.B., Chapter 7, The Charging of Spacecraft Surfaces, downloaded from http://cnofs.org/ on Nov. 2, 2018, 37 pages.
"LLL Magnetic Fusion Energy Program: An Overview," Energy & Technology Review, Lawrence Livermore National Laboratory, Jun. 1976, 30 pages.

* cited by examiner

RADIATION SHIELD

FIELD OF INVENTION

The present invention relates to systems and methods for radiation shielding.

BACKGROUND

Electronics are exposed to radiation in many different environments. For example, electronics in space (e.g., in satellites) are subject to space radiation such as cosmic rays or solar weather. Similarly, electronics near nuclear reactors and other radioactive terrestrial sources can also face radiation. Radiation, and in particular ionizing radiation, can damage electronics through a variety of mechanisms. Single event effects, for instance, can range from a relatively minor output error or bit flip to permanent hardware damage/failure. As such, many electronics are routinely threatened by exposure to radiation. Smaller electronic are at even higher risk as they can suffer radiation damage relatively quickly.

SUMMARY

In one form, an apparatus for radiation shielding is provided. The apparatus includes a first housing element and a first plurality of magnetic elements arranged in a first array on the first housing element. The first array is configured to generate a first tapered magnetic field and, using the first tapered magnetic field, deflect incoming radiation away from a protected element.

In one example, the first plurality of magnetic elements includes a first plurality of multipole magnets. The first plurality of multipole magnets may include a first plurality of quadrupole magnets. In a first example, the first plurality of magnetic elements includes a first plurality of magnetic elements having octagonal cross-sections. In a second example, the first plurality of magnetic elements includes a first plurality of C-hairpin-shaped magnets. The first plurality of C-hairpin-shaped magnets may include a first plurality of nested or interlocking C-hairpin-shaped magnets.

In another example, the apparatus further comprises a second housing element and a second plurality of magnetic elements arranged on the second housing element in a second array between the first array and the protected element. The second array is configured to generate a second tapered magnetic field and, using the second tapered magnetic field, deflect the incoming radiation away from the protected element. The first and second arrays may be configured to generate a magnetic bottle to contain the radiation. Furthermore, the first tapered magnetic field may be crossed with the second magnetic field.

In another form, a method of radiation shielding is provided. The method includes the steps of positioning a first array of magnetic elements between an element to be protected and a radiation source; using the first array of magnetic elements to generate a first tapered magnetic field; and using the first tapered magnetic field, deflecting incoming radiation away from a protected element.

DETAILED DESCRIPTION

Figure 1:
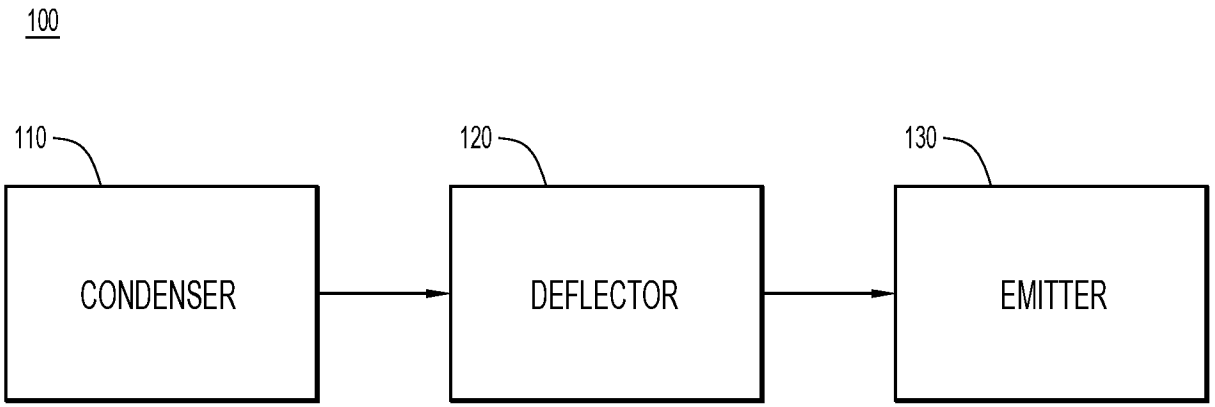
FIG. 1 illustrates a functional block diagram of an apparatus for radiation shielding, in an example embodiment.

FIG. 1 is a functional block diagram 100 of an example apparatus for radiation shielding. Functional block diagram 100 includes a condenser 110, deflector 120, and emitter 130. Condenser 110 represents functionality for magnetic confinement of incoming radiation (e.g., relativistic incoming radiation). Deflector 120 represents functionality for deflecting the incoming radiation away from a protected element (e.g., electronics, such as a Fin Field Effect Transistor (FinFET)). Emitter 130 represents functionality for emitting the radiation from, e.g., a magnetic funnel generated by the apparatus for radiation shielding.

Figure 2A:
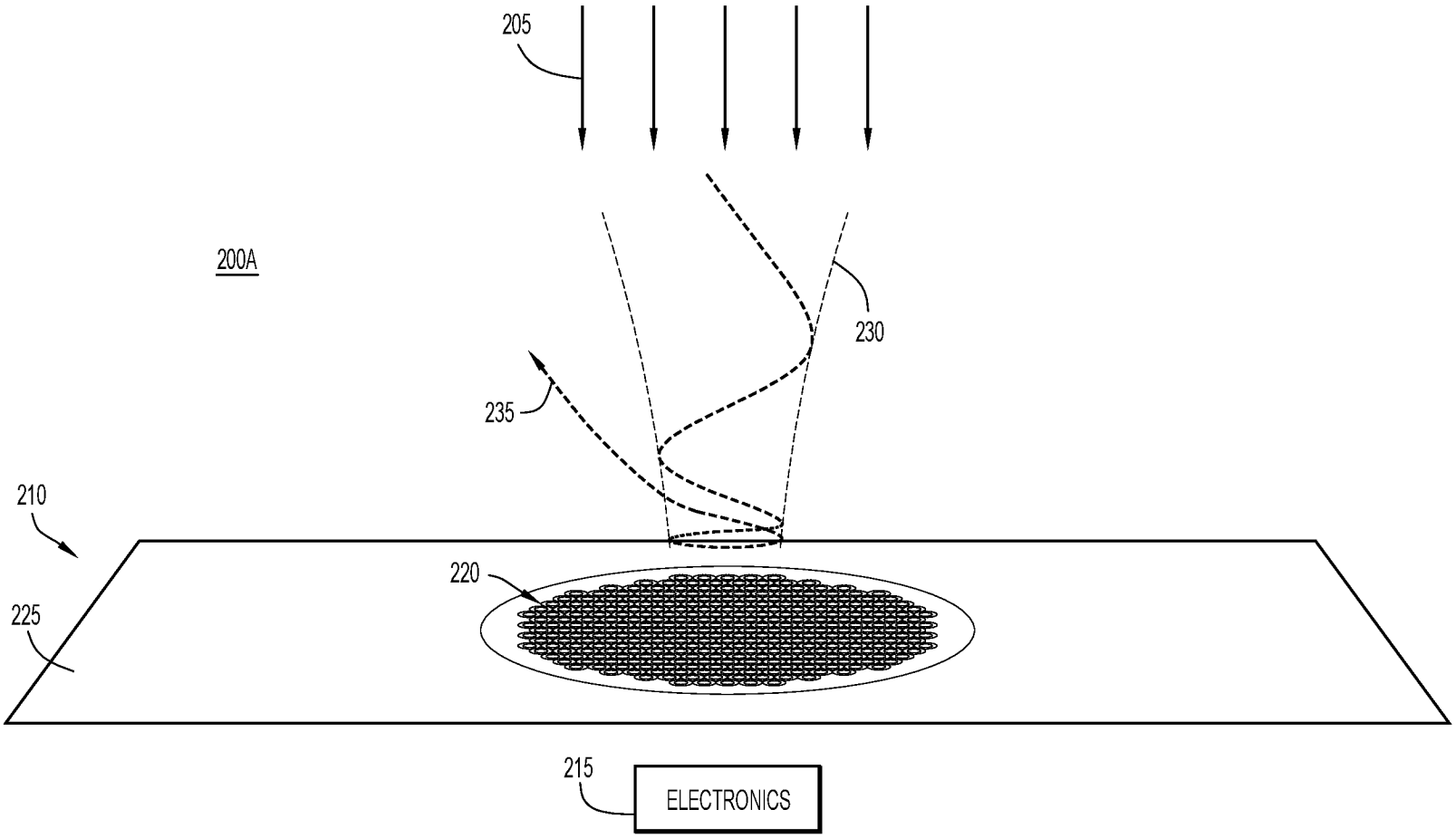
FIG. 2A is a perspective view of a system for radiation shielding, in an example embodiment.

FIG. 2A is a perspective view of a system 200A for radiation shielding according to an example embodiment. As shown, incoming radiation 205 approaches system 200A, which includes radiation shield 210 and protected element (e.g., electronics) 215. Incoming radiation 205 may have a heterogeneous source, and may be a planar sheet of charged particles (ions) aimed at protected element 215. Radiation shield 210 may be configured to perform operations corresponding to functionalities 110-130 as discussed in connection with FIG. 1 above. In particular, radiation shield 210 includes a housing element 225 and a plurality of magnetic elements 220 arranged in an array on the housing element 225. In the example shown in FIG. 2A, the housing element 225 is disposed between the incoming radiation 205 and the asset or element to be protected (e.g., electronics) 215. The housing element 225 and array of magnetic elements 220 may be planar as shown and oriented perpendicular to the direction of incoming radiation.

The array of the plurality of magnetic elements 220 is configured to generate a tapered magnetic field 230. In the example shown in FIG. 2A, the tapered magnetic field 230 is a generally funnel-shaped magnetic field extending outwardly from the array 220 in a direction perpendicular to a plane of the array. In the example shown, the tapered magnetic field 230 is oriented with its narrow end facing toward the array of magnetic elements 220 and its wide end facing away from the array of magnetic elements 220. The sides of the tapered magnetic field 230 may curve outwardly as shown. Using tapered magnetic field 230, the array of the plurality of magnetic elements 220 is further configured to deflect incoming radiation 205 away from protected element 215, as illustrated at 235. Thus, radiation shield 210 protects protected element 215 by reflecting the incoming radiation using a magnetic mirror (tapered magnetic field 230) and ejecting the incoming radiation. In one example, the tapered magnetic field 230 trails off more gradually in the longitudinal direction than in the transverse direction. The flux density may increase as the incoming radiation 205 approaches the array of magnetic elements 220.

Figure 2B:
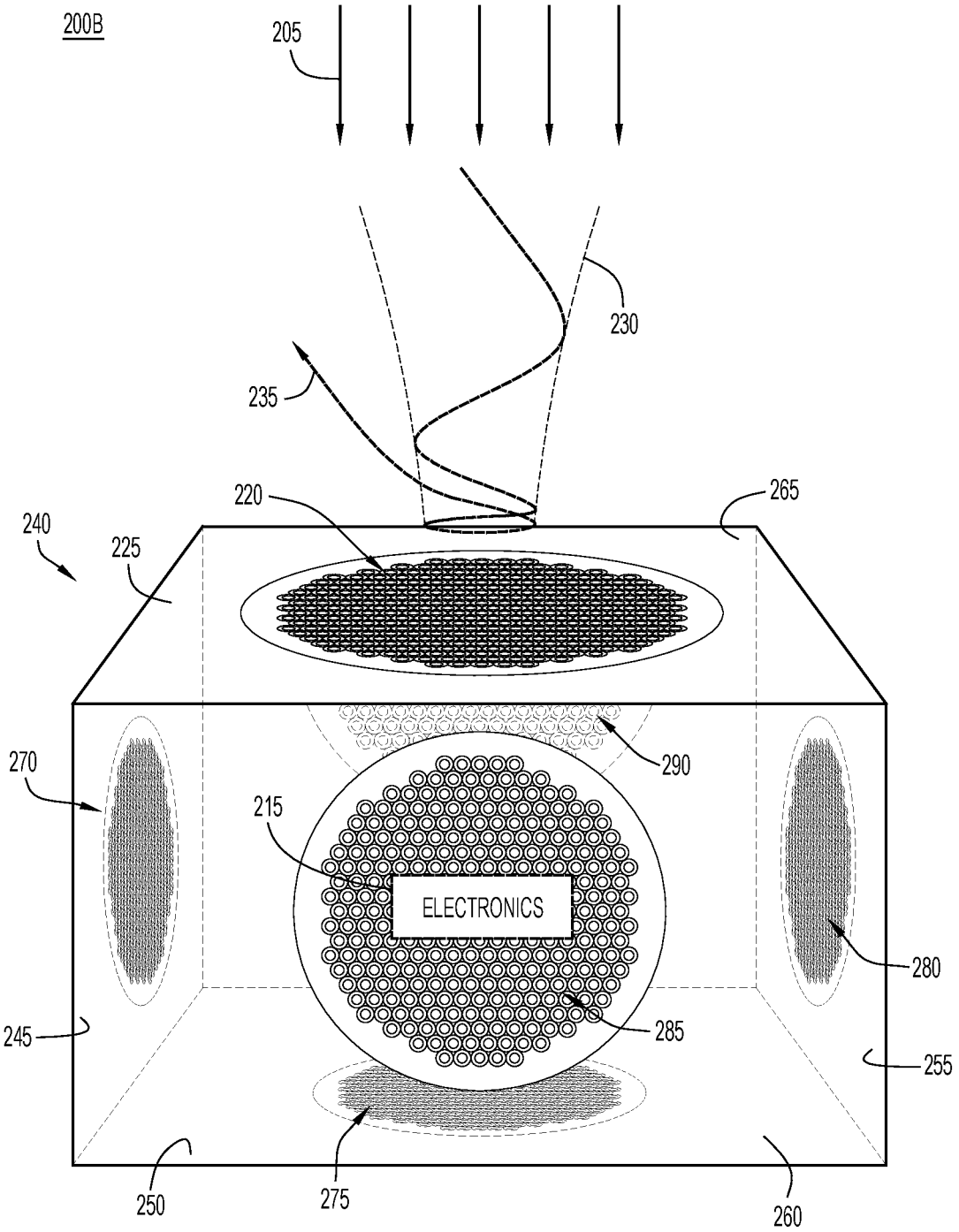
FIG. 2B is a perspective view of a system for radiation shielding, in another example embodiment.

FIG. 2B is a perspective view of a system 200B for radiation shielding according to another example embodiment. System 200B includes a three-dimensional radiation shield 240. Radiation shield 240 includes a housing that includes housing elements 225 (top side), 245 (left side), 250 (bottom side), 255 (right side), 260 (front side), and 265 (back side). The housing elements define a generally polyhedron shaped housing with six sides. Respective plurality of magnetic elements 220, 270, 275, 280, 285, and 290 are arranged in respective arrays on respective housing elements 225, 245, 250, 255, 260, and 265. Each array of the plurality of magnetic elements 220, 270, 275, 280, 285, and 290 is configured to generate a respective tapered magnetic field (e.g., tapered magnetic field 230) and, using the respective tapered magnetic field, deflect incoming radiation (e.g., incoming radiation 205) away from protected element 215. The arrays of the plurality of magnetic elements 220, 270, 275, 280, 285, and 290 may be configured/manufactured identically or similarly to each other.

A radiation shield as described herein may be any suitable substantially two-dimensional shape (e.g., square, polygon, etc.), an example of which is illustrated in FIG. 2A, or any suitable substantially three-dimensional shape (e.g., parallelepiped, box, etc.), an example of which is illustrated in FIG. 2B. For example, radiation shield(s) 210 and/or 240 may be located on the side of a satellite, and protected element 215 may be sensitive electronics or other assets inside the satellite. In this example, incoming radiation 205 may include cosmic rays, solar radiation, etc. Radiation shields 210 and 240 may be referred to as one-stage radiation shields.

Figure 2C:
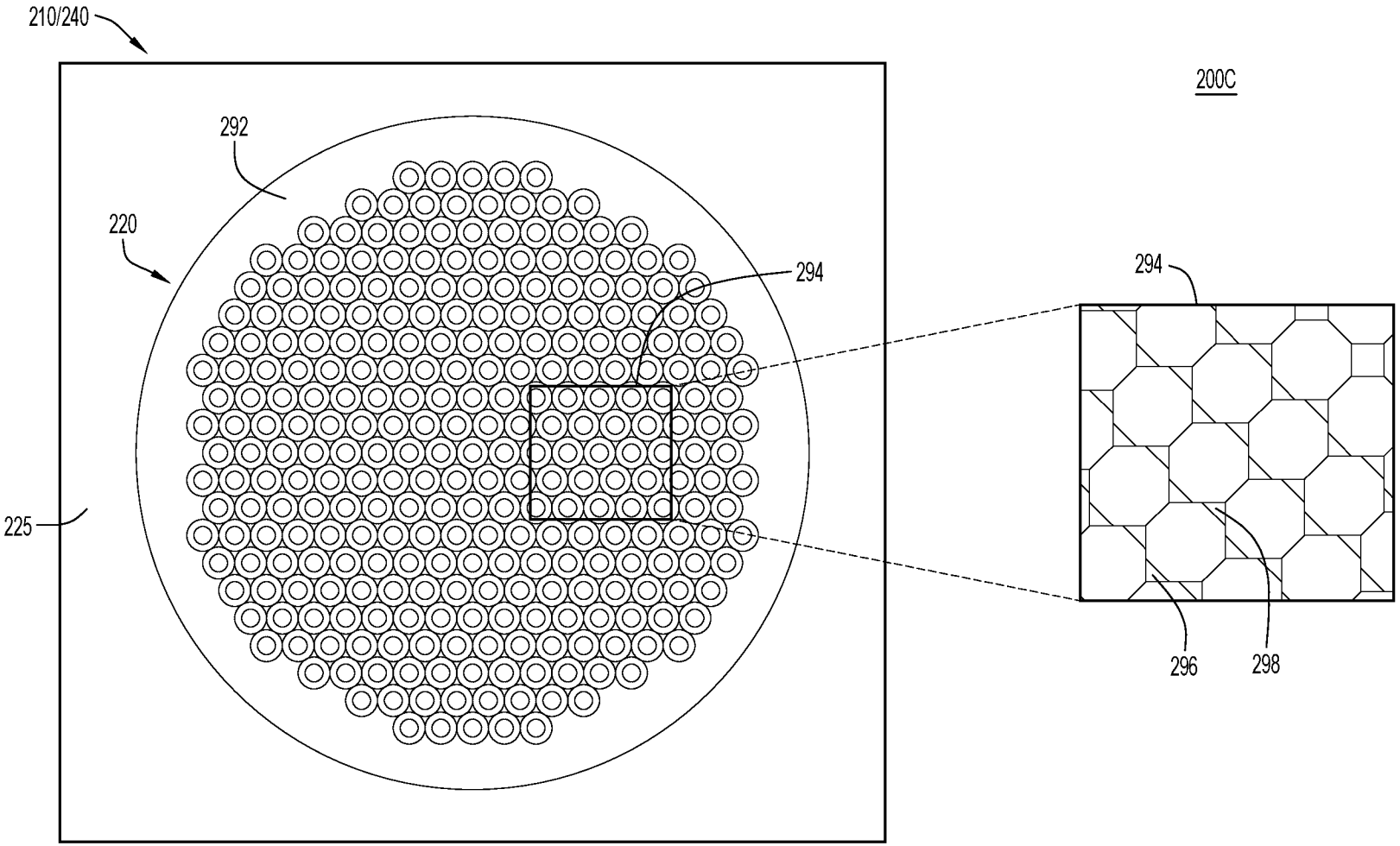
FIG. 2C is a plan view of an array of magnetic elements for use in the system(s) of FIG. 2A and/or FIG. 2B, in an example embodiment.

FIG. 2C is a plan view 200C of system(s) 200A and/or 200B. As shown, the plurality of magnetic elements 220 may be arranged in an array on wafer 292. In this example, wafer 292 is a flat disc-like element that is generally circular, but may take any suitable shape (e.g., square, rectangle, oval, etc.) in other embodiments. Wafer 292 may be any suitable material, including but not limited to a dielectric material with a low dipole moment, such as quartz, polyimide, semiconductor (silicon or silicon carbide) coated with silicon dioxide or silicon nitride, etc.

FIG. 2C also illustrates a magnified view of area 294 of the array of the plurality of magnetic elements 220. In this example, the plurality of magnetic elements 220 have octagonal cross-sections. The plurality of magnetic elements 220 are closely packed in wafer 292 to form a plurality of weep holes, such as weep holes 296 and 298. For ease of illustration, only weep holes 296 and 298 are labeled with element numbers, although it will be appreciated that the plurality of weep holes may include other weep holes in addition to weep holes 296 and 298. In one example, the weep holes may be filled with a permanent magnet.

The plurality of magnetic elements 220 may have poles in a common plane such that arrays of opposing pairs of north poles are symmetric about the center of wafer 292, with interleaved arrays of pairs of south poles. This magnetic fringing may distribute the magnetic field in the volume between opposing pole tips. The tapered magnetic field 230 may be produced by varying the strength and/or tilt of the plurality of magnetic elements 220 from the center to the edge of the wafer 292.

The plurality of magnetic elements 220 may be any suitable shape. For example, the plurality of magnets 220 may be generally circular, having an outer edge circumscribed by a generally circular component (e.g., wafer 292). Examples of other suitable shapes include gradients, cylinders, disks, etc. The plurality of magnetic elements 220 may have cross sections of any suitable regular polygon having any suitable number of sides. The plurality of magnetic elements 220 may also/alternatively have cross-sections of circular or any other suitable shape. Furthermore, the plurality of magnets 220 may include magnetic materials such as AlNiCo5, Sm2Co17, NdFeB, SrFe12O19, etc.

The plurality of magnetic elements 220 may be permanent or electromagnetic magnets. In one example, each magnetic element in the plurality of magnetic elements 220 may be individually controllable to provide dynamic flexibility to radiation shield 210/240. For example, individual control may enable the array of the plurality of magnetic elements 220 to generate tapered magnetic field 230 by producing combined dipole-quadrupole fields (e.g., dipole field strength and quadrupole field gradient). The array of the plurality of magnetic elements 220 may be matched in size and scale to anticipated external radiation intensity/source and payload sensitivities as appropriate.

Figure 3B:
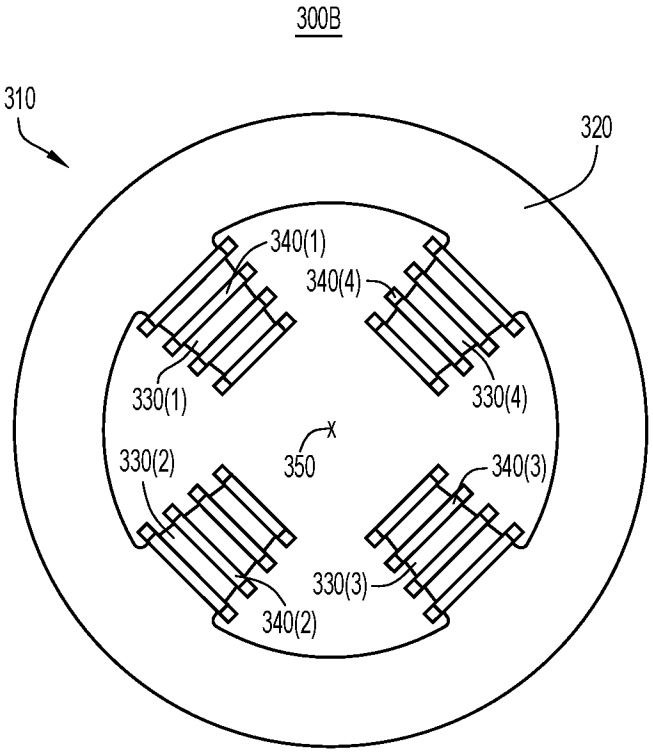
FIG. 3B is a plan view of the magnetic element of FIG. 3A, in an example embodiment.
Figure 3A:
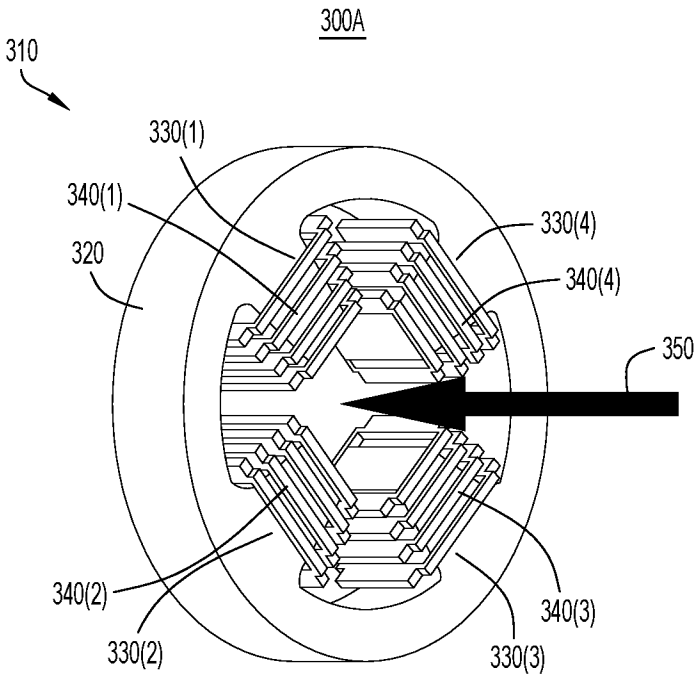
FIG. 3A is a perspective view of a magnetic element for use in a system for radiation shielding, in an example embodiment.

FIG. 3A is a perspective view 300A of an example magnetic element 310. Magnetic element 310 may be one microscale magnetic element of a plurality of magnetic elements in a radiation shield as described herein. Magnetic element 310 includes a ring 320 with spokes 330(1)-330(4) extending inwards towards the center of ring 320. Magnetic element 310 further includes windings 340(1)-340(4) respectively wound about spokes 330(1)-330(4). Magnetic element 310 is a multipole magnet. More specifically, magnetic element 310 is a quadrupole magnet, although any suitable n-pole magnet may be used (e.g., sextupole, octupole, etc.). Arrow 350 illustrates the direction of incoming radiation toward magnetic element 310. FIG. 3B is a plan view 300B of magnetic element 310.

Ring 320 may be any suitable material to secure spokes 330(1)-330(4) and windings 340(1)-340(4) without interfering with the magnetic field produced by magnetic element 310. Spokes 330(1)-330(4) may be magnetic yokes to enhance the magnetic field (e.g., permalloy 80/20). In one example, the magnetic yokes may be grown inside windings 340(1)-340(4). Windings 340(1)-340(4) may include any suitable conductor (e.g., copper). Windings 340(1)-340(4) may include an insulating/supporting material (e.g., dielectric) between the windings 340(1)-340(4) to prevent contact between/among the windings 340(1)-340(4).

Magnetic element 310 may be manufactured using combined fabrication techniques developed for integrated circuits and memory. Magnetic element 310 may also be separated by die singulation and packaged using flip chip methods. Alternatively, magnetic element 310 may be laser-machined into a permanent magnet array with spatially alternating magnetic fields.

Figure 4B:
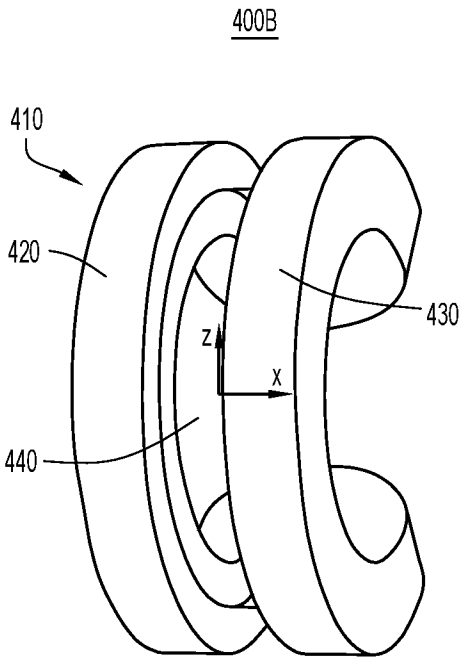
FIGS. 4A and 4B are perspective views of a C-hairpin-shaped magnet, in an example embodiment.
Figure 4A:
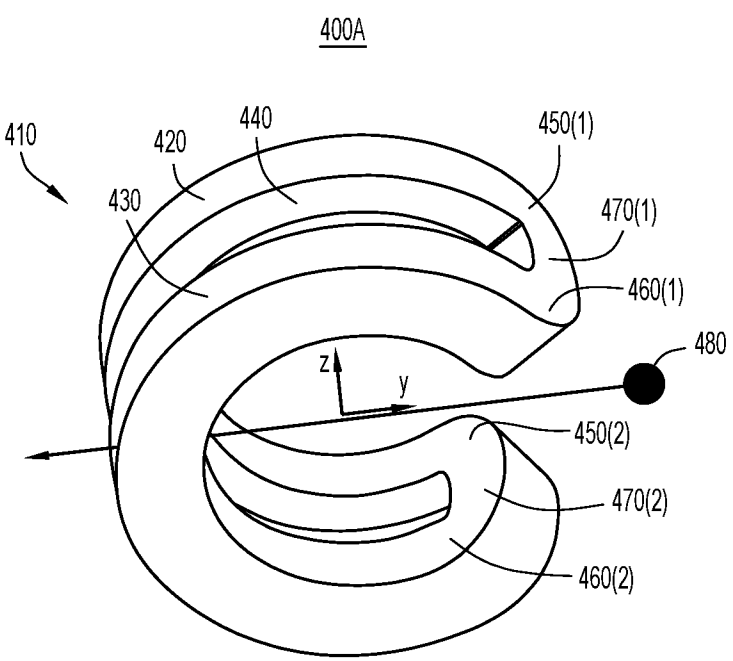

FIGS. 4A and 4B are perspective views 400A and 400B of an example C-hairpin-shaped magnet 410. C-hairpin-shaped magnet 410 may be one magnetic element of a plurality of magnetic elements in a radiation shield as described herein. In the example shown, the C-hairpin-shaped magnet 410 includes a pair of C-shaped sections 420 and 430 parallel to one another with a small gap 440 therebetween. Tips 450(1), 450(2), 460(1), and 460(2) of the C-shaped sections are connected by cross members 470(1) and 470(2) that extend across the small gap 440. FIG. 4A also illustrates the path an ion 480 might take as it passes through the C-hairpin-shaped magnet 400. More specifically, the C-hairpin-shaped magnet 400 may be oriented so that an ion passes through the gap 440 between the C-shaped sections 420 and 430 of the magnet.

Figure 4D:
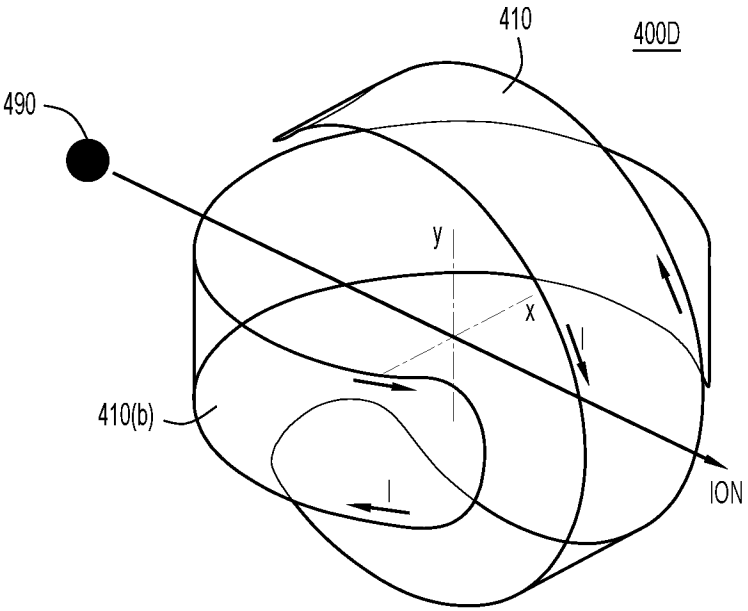
FIG. 4D is a perspective view of interlocking C-hairpin-shaped magnets, in an example embodiment.
Figure 4C:
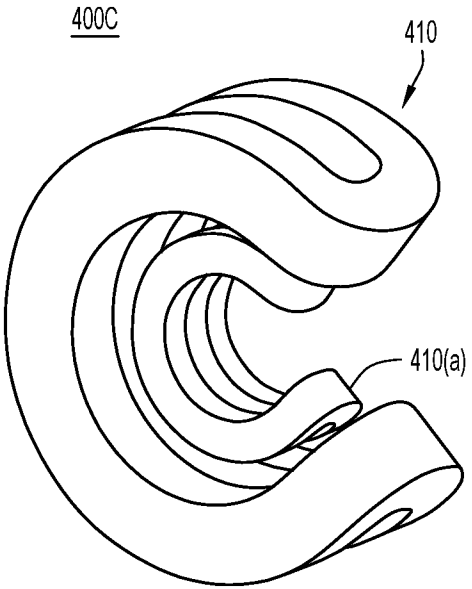
FIG. 4C is a perspective view of nested C-hairpin-shaped magnets, in an example embodiment.

FIG. 4C is a perspective view 400C of example nested C-hairpin-shaped magnets 410 and 410(*a*). C-hairpin-shaped magnets 410 and 410(*a*) may be one magnetic element of a plurality of magnetic elements in a radiation shield as described herein. In this embodiment, C-hairpin-shaped magnet 410(*a*) is a scaled-down version of magnet 410, and may be sized to fit within C-hairpin-shaped magnet 410. As shown, C-hairpin-shaped magnet 410(*a*) is nested in C-hairpin-shaped magnet 410. C-hairpin-shaped magnets 410 and 410(*a*) are also parallel to one another. The nested configuration provides greater design flexibility, enabling the adjustment of both the magnitude and shape (e.g., symmetric or asymmetric) of the magnetic field.

FIG. 4D is a perspective view 400D of example interlocking C-hairpin-shaped magnets 410 and 410(*b*). C-hairpin-shaped magnets 410 and 410(*b*) may be one magnetic element of a plurality of magnetic elements in a radiation shield as described herein. In this embodiment, C-hairpin-shaped magnet 410(*b*) is similar to C-hairpin-shaped magnet 410, but is oriented perpendicular to C-hairpin-shaped magnet 410. C-hairpin-shaped magnet 410(*b*) is arranged to fit interlockingly with C-hairpin-shaped magnet 410 (e.g., with open sides facing one another). FIG. 4D further illustrates the path an ion 490 might take as it passes through C-hairpin-shaped magnets 410 and 410(*b*). Like the nested configuration, the interlocking configuration provides greater design flexibility, enabling the adjustment of both the magnitude and shape of the magnetic field.

Figure 5:
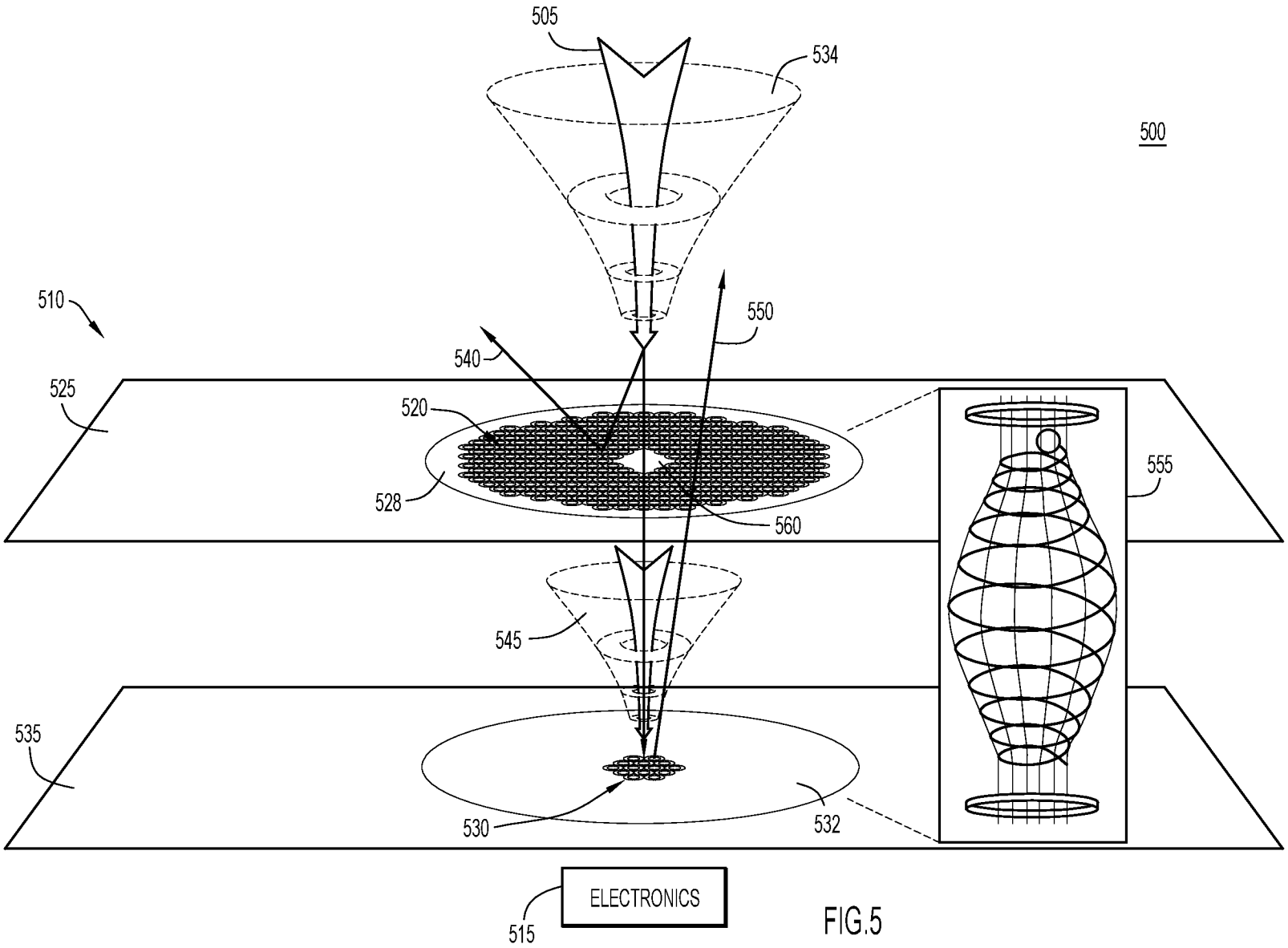
FIG. 5 is a perspective view of another system for radiation shielding, in an example embodiment.

FIG. 5 is a perspective view of an example system 500 for radiation shielding. As shown, incoming radiation 505 approaches system 500, which includes radiation shield 510 and protected element (e.g., electronics) 515. Incoming radiation 505 may be a planar sheet of charged particles (ions) aimed at protected element 515. Radiation shield 510 may be configured to perform operations corresponding to functionalities 110-130 as discussed in connection with FIG. 1 above. In particular, radiation shield 510 includes a first plurality of magnetic elements 520 and housing element 525. The first plurality of magnetic elements 520 is arranged in a first array on the housing element 525. The plurality of magnetic elements 520 may be arranged in the first array by wafer 528.

Radiation shield 510 further includes a second plurality of magnetic elements 530 and housing element 535. The second plurality of magnetic elements 530 are arranged in a second array on housing element 535. The second array of the plurality of magnetic elements 530 is disposed between the first array of the plurality of magnetic elements 520 and the protected element 515. The plurality of magnetic elements 530 may be arranged in the second array by wafer 532. In this example, wafer 532 is wider than wafer 528, and the first array of the plurality of magnetic elements 520 is wider than the second array of the plurality of magnetic elements 530.

The first array of the plurality of magnetic elements 520 is configured to generate a tapered magnetic field 534. Tapered magnetic field 534 may be a magnetic vortex with a magnetic pinch near first plurality of magnetic elements 520. Using tapered magnetic field 534, the array of the plurality of magnetic elements 520 is further configured to deflect incoming radiation 505 away from protected element 515, as illustrated at 540. Similarly, the second array of the plurality of magnetic elements 530 is configured to generate a tapered magnetic field 545. Using tapered magnetic field 545, the array of the plurality of magnetic elements 530 is further configured to deflect incoming radiation 505 away from protected element 515, as illustrated at 550. The first array of the plurality of magnetic elements 520 and the second array of the plurality of magnetic elements 530 may be configured to generate a magnetic bottle 555 to contain/trap incoming radiation 505.

In one example, incoming radiation 505 includes particles having trajectories greater than and less than 5 degrees relative to the perpendicular direction to housing elements 525 and 535. The particles may have a velocity aimed at the first array of the plurality of magnetic elements 520. The first array of the plurality of magnetic elements 520 may deflect particles having trajectories greater than 5 degrees at angles greater than 30 degrees, as illustrated at 540. The first array of the plurality of magnetic elements 520 may also be arranged to form a gap 560 through which stronger incoming radiation 505 (e.g., particles having trajectories less than 5 degrees pass) may pass. The second array of the plurality of magnetic elements 530 may deflect particles having trajectories less than 5 degrees through weep holes in the first array of the plurality of magnetic elements 520 (e.g., similar to weep holes 296 and 298 as illustrated in FIG. 2) or trap that incoming radiation 505 in magnetic bottle 555. Thus, radiation shield 510 may be referred to as a two-stage radiation shield, with tapered magnetic fields 534 and 545 acting as a funnel collector, conditioner and reflector, and emitter.

Figure 6A:
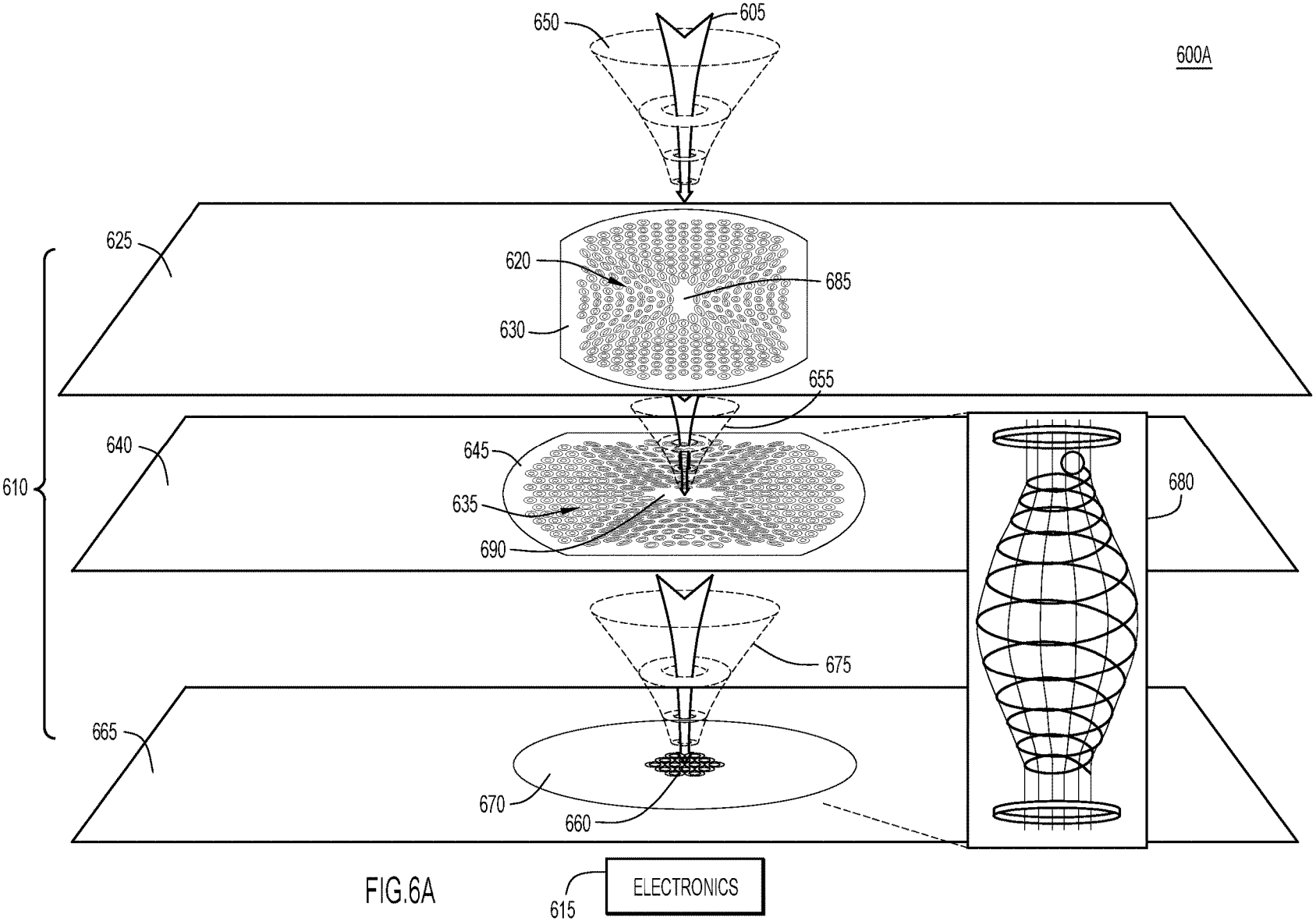
FIG. 6A is a perspective view of yet another system for radiation shielding, in an example embodiment.

FIG. 6A is a perspective view of an example system 600A for radiation shielding. As shown, incoming radiation 605 approaches system 600A, which includes radiation shield 610 and protected element (e.g., electronics) 615. Incoming radiation 605 may be a planar sheet of charged particles (ions) aimed at protected element 615. Radiation shield 610 may be configured to perform operations corresponding to functionalities 110-130 as discussed in connection with FIG. 1 above. In particular, radiation shield 610 includes a first plurality of magnetic elements 620 and housing element 625. The first plurality of magnetic elements 620 are arranged in a first array on housing element 625. The plurality of magnetic elements 620 may be arranged in the first array in a substantially ovular shape by wafer 630.

Radiation shield 610 further includes a second plurality of magnetic elements 635 and housing element 640. The second plurality of magnetic elements 635 are arranged in a second array on housing element 640. The second array of the plurality of magnetic elements 635 is disposed between the first array of the plurality of magnetic elements 620 and the protected element 615. The plurality of magnetic elements 635 may be arranged in the second array in a substantially ovular shape by wafer 640.

The first array of the plurality of magnetic elements 620 is configured to generate a tapered magnetic field 650. Using tapered magnetic field 650, the first array of the plurality of magnetic elements 620 is further configured to deflect incoming radiation 605 away from protected element 615. Similarly, the second array of the plurality of magnetic elements 635 is configured to generate a tapered magnetic field 655. Using tapered magnetic field 655, the second array of the plurality of magnetic elements 635 is further configured to deflect incoming radiation 605 away from protected element 615.

Tapered magnetic fields 650 and 655 may be cylindrically asymmetric. This may be accomplished by tilting housing element 640 with respect to housing elements 625 and 665. In one example, tapered magnetic field 650 may be crossed with tapered magnetic field 655. Because the first array of the plurality of magnetic elements 620 and the second array of the plurality of magnetic elements 635 both produce distorted magnetic funnels, toggling of the first array of the plurality of magnetic elements 620 and the second array of the plurality of magnetic elements 635 may enable control over the directionality of magnetic funnels. For example, varying the power supplied over the first array of the plurality of magnetic elements 620 may cause tapered magnetic field 650 to take on a specific shape/orientation.

Radiation shield 610 further includes a third plurality of magnetic elements 660 and housing element 665. The third plurality of magnetic elements 660 are arranged in a third array on housing element 665. The third array of the plurality of magnetic elements 635 is disposed between the second array of the plurality of magnetic elements 635 and the protected element 615. The plurality of magnetic elements 660 may be arranged in the third array by wafer 670. The third array of the plurality of magnetic elements 660 is configured to generate a tapered magnetic field 675. Using tapered magnetic field 675, the array of the plurality of magnetic elements 660 is further configured to deflect incoming radiation 605 away from protected element 615. The third array of the plurality of magnetic elements 660 and the second array of the plurality of magnetic elements 635 may be configured to generate a magnetic bottle 680 to contain/trap incoming radiation 605.

In one example, incoming radiation 605 with a trajectory greater than 5 degrees has a velocity aimed at the first array of the plurality of magnetic elements 620 and the second array of the plurality of magnetic elements 635, which deflect that incoming radiation 505 at angles greater than 30 degrees. The first array of the plurality of magnetic elements 620 may be arranged to form a gap 685 through which stronger incoming radiation 605 with a trajectory less than 5 degrees may pass. Similarly, the second array of the plurality of magnetic elements 635 may be arranged to form a gap 690 through which stronger incoming radiation 605 with a trajectory less than 5 degrees may pass. The third array of the plurality of magnetic elements 660 may deflect that incoming radiation 605 through weep holes in the first array of the plurality of magnetic elements 620 and/or weep holes in the first array of the plurality of magnetic elements 635 (e.g., similar to weep holes 296 and 298 as illustrated in FIG. 2) or trap that incoming radiation 605 in magnetic bottle 680. Thus, radiation shield 610 may be referred to as a two-stage radiation shield, with tapered magnetic fields 650, 655, and 675 acting as a funnel collector, enhanced conditioner and reflector, and emitter.

Figure 6C:
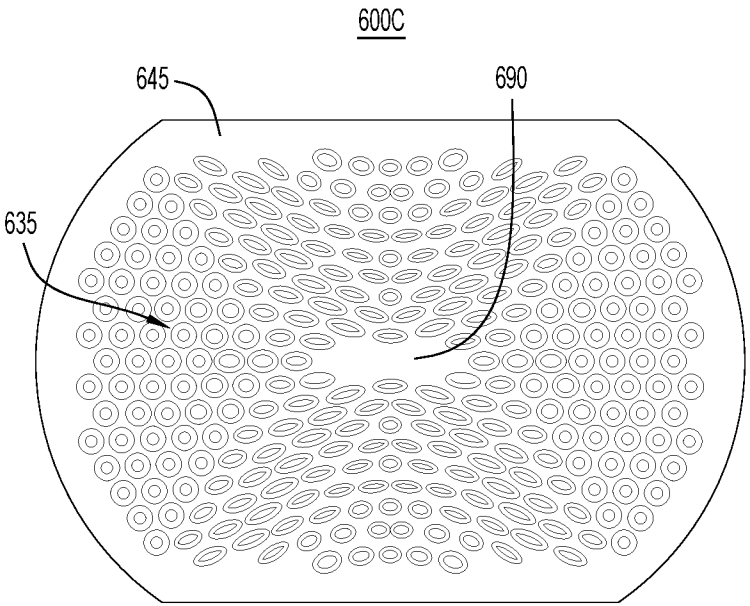
FIGS. 6B and 6C are plan views of magnetic arrays of FIG. 6A, in an example embodiment.
Figure 6B:
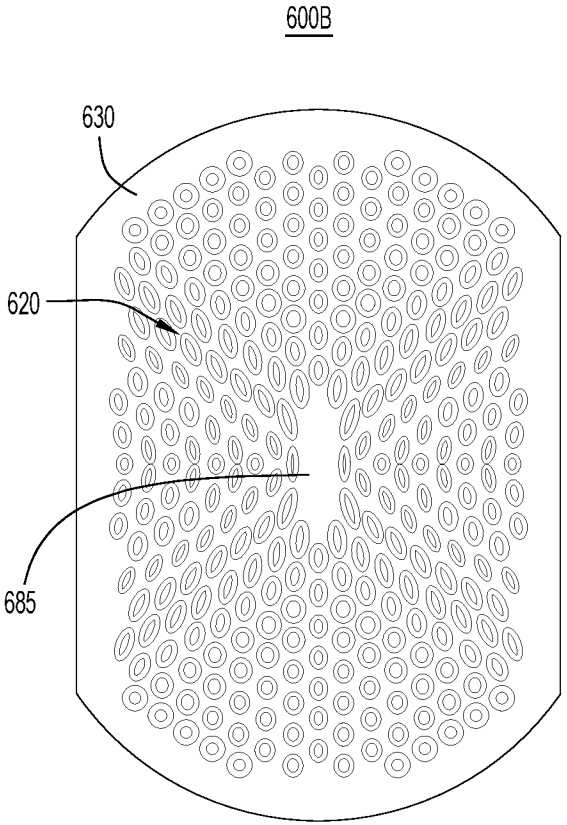

FIGS. 6B and 6C illustrate plan views 600B and 600C of the first array of the plurality of magnetic elements 620 and the second array of the plurality of magnetic elements 635. As shown, the plurality of magnetic elements 620 may be arranged in the first array in a substantially ovular shape by wafer 630. The first array of the plurality of magnetic elements 620 may be arranged to form gap 685 through which stronger incoming radiation 605 may pass. Similarly, the plurality of magnetic elements 635 may be arranged in the second array in a substantially ovular shape by wafer 645. The first array of the plurality of magnetic elements 635 may be arranged to form gap 690 through which stronger incoming radiation 605 may pass.

Figure 7:
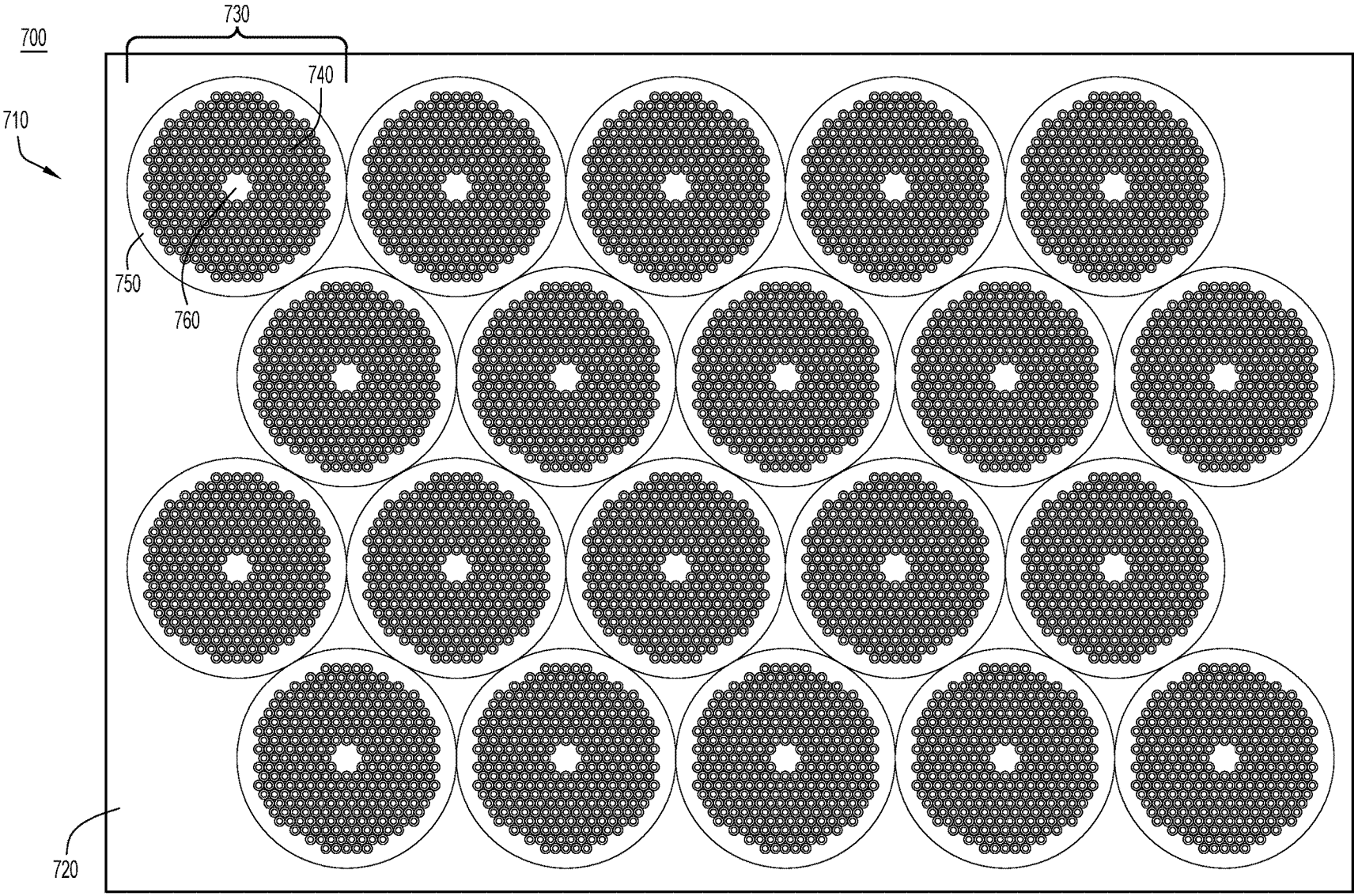
FIG. 7 is a plan view of a radiation shield that includes a plurality of arrays of magnetic elements, in an example embodiment.

FIG. 7 is a plan view 700 of an example radiation shield 710. Radiation shield 710 includes a housing element 720 and pluralities of magnetic elements respectively arranged in a plurality of arrays on the housing element 720. For ease of illustration, reference numerals are shown for one array 730 of the plurality of arrays, although it will be appreciated that each of the plurality of arrays may be similar or identical to array 730. Array 730 includes a plurality of magnetic elements 740 configured to generate a tapered magnetic field as described herein. The plurality of magnetic elements 740 may be arranged in array 730 by wafer 750. Array 730 may be arranged to form a gap 760 through which stronger incoming radiation may pass. Thus, radiation shield 710 may comprise a "super-array" of a wall of a plurality of arrays.

Figure 8B:
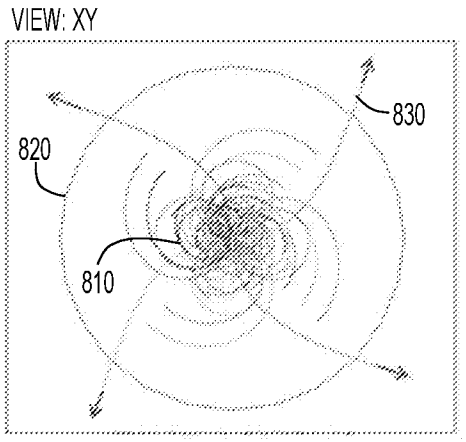
FIGS. 8A and 8B are respective side and front views of simulated trajectories of particles influenced by an apparatus for radiation shielding, in an example embodiment.
Figure 8A:
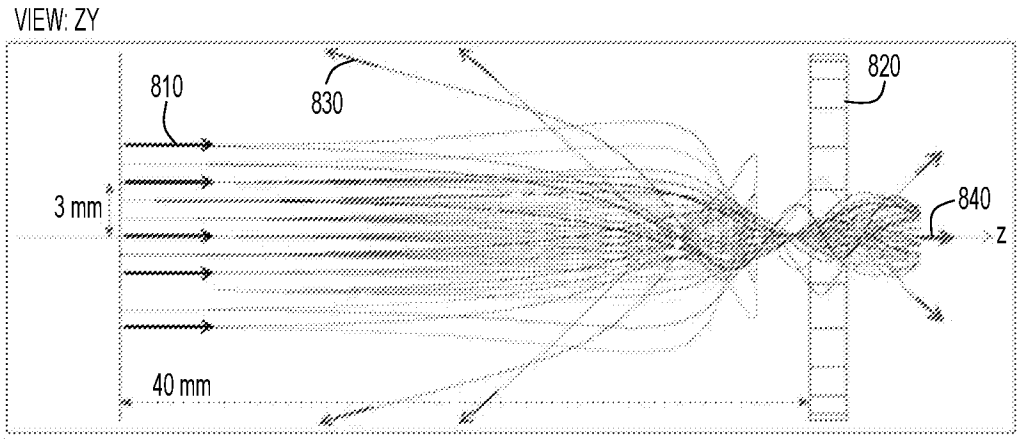

FIGS. 8A and 8B are respective example elevation views 800A and 800B of simulated radiation trajectories influenced by an apparatus for radiation shielding. View 800A illustrates a ZY planar view of incoming radiation 810 propagating toward magnetic element 820, which is configured to produce a tapered magnetic field. Some of the incoming radiation 810 is deflected by magnetic element 820, as shown at 830, and some of the incoming radiation 810 travels through magnetic element 820, as shown at 840. View 800B illustrates an XY planar view of the same event.

In one example, incoming radiation 810 is a sheet of incident electrons, and the magnetic field at the center of magnet element 820 is 1.9E-3 T. Electrons incident at an off z-axis distance of greater than 4 mm are reflected back. Electrons incident at an off z-axis distance of 4 mm contacts the magnet pupil radius of 3 mm. Electrons incident at an off z-axis distance of less than 4 mm passes through magnet pupil radius (e.g., at 2 mm).

Figure 9B:
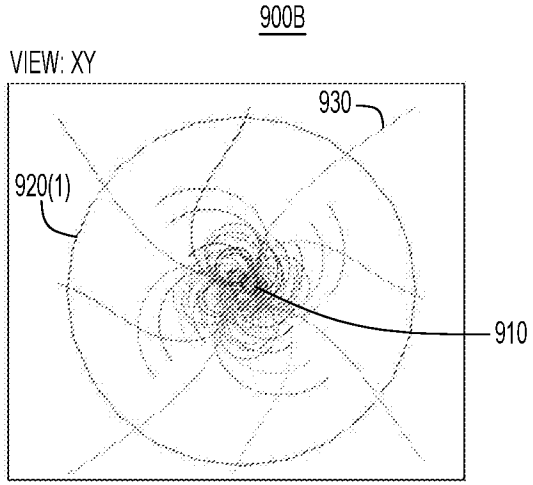
FIGS. 9A and 9B are respective side and front views of further simulated trajectories of particles influenced by an apparatus for radiation shielding, in an example embodiment.
Figure 9A:
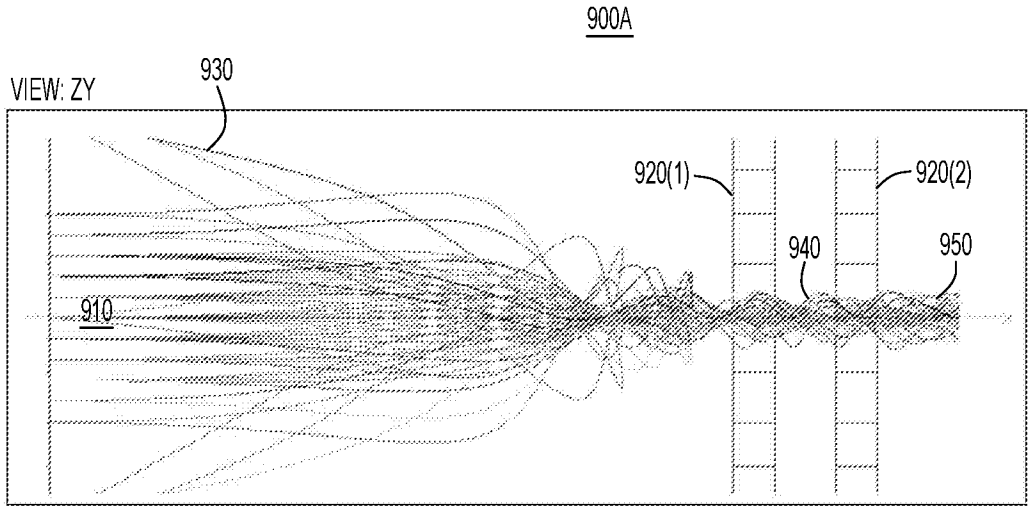

FIGS. 9A and 9B are respective elevation views 900A and 900B of simulated radiation trajectories influenced by an apparatus for radiation shielding. View 900A illustrates a ZY planar view of incoming radiation 910 propagating toward magnetic elements 920(1) and 920(2), both of which are configured to produce a tapered magnetic field. Some of the incoming radiation 910 is deflected by magnetic element 920(1), as shown at 930, and some of the incoming radiation 910 travels through magnetic element 920(1) toward magnetic element 920(2), as shown at 940. Furthermore, some of incoming radiation 940 is deflected by magnetic element 920(2), and some of incoming radiation 940 travels through magnetic element 920(1), as shown at 950. In one specific example, incoming radiation 940 has an Atomic Mass Unit (AMU) of 5 and a charge of 2. View 900B illustrates an XY planar view of the same event.

Figures 10A, 10B, 10C:
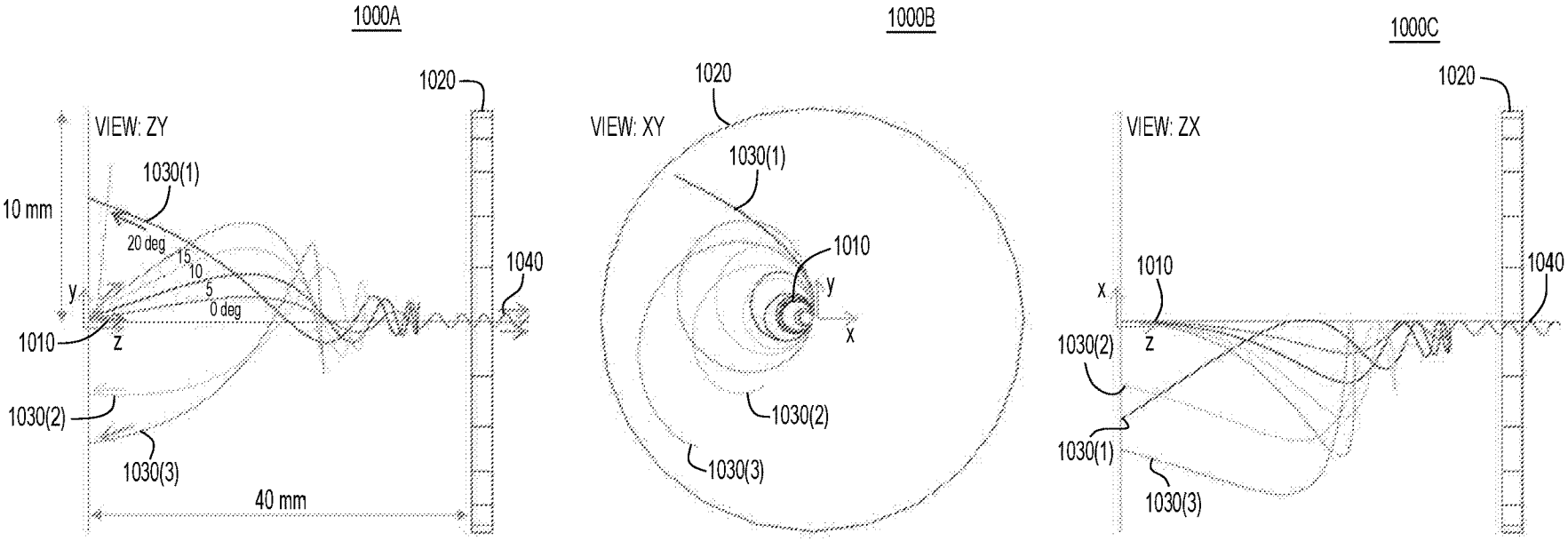
FIGS. 10A-10C are respective side, front, and top views of still further simulated trajectories of particles influenced by an apparatus for radiation shielding, in an example embodiment.

FIGS. 10A-10C are respective elevation views 1000A, 1000B, and 1000C of simulated radiation trajectories influenced by an apparatus for radiation shielding. View 1000A illustrates a ZY planar view of incoming radiation 1010 propagating toward cylindrical/disk-shaped magnetic element 1020, which is configured to produce a tapered magnetic field. Incoming radiation 1010 may include electrons with an entry velocity of 1.0 m/s. The incoming radiation 1010 has varying angles of entry (0, 5, 10, 15, and 20 degrees). The incoming radiation 1010 with angles of entry of 10, 15, and 20 degrees is deflected by magnetic element 1020, as shown at 1030(1)-1030(3). The incoming radiation 1010 with angles of entry of 0 and 5 degrees travels through magnetic element 1020, as shown at 1040. View 1000B illustrates an XY planar view of the same event, and view 1000C illustrates a ZX planar view of the same event.

Figure 10D:
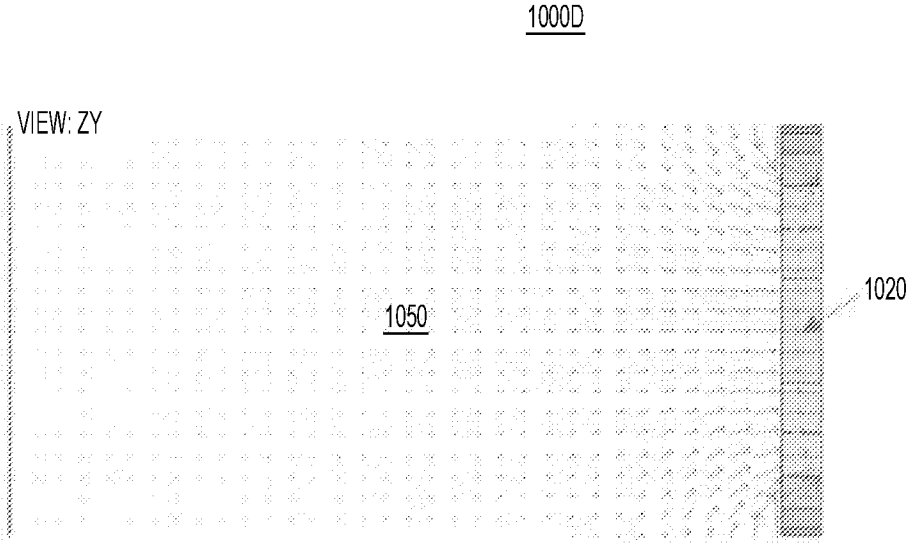
FIG. 10D is a side view of a magnetic field influencing the trajectories of particles in FIGS. 10A-10C, in an example embodiment.

FIG. 10D is an example elevation view 1000D of a magnetic field influencing the trajectories of incoming radiation 1010. Like view 1000A, view 1000D is a ZY planar view. The magnetic field may be a tapered magnetic field 1050 produced by magnetic element 1020. In one example, the magnetic field at the center of magnetic element 1020 is 7.5E-3 T.

Figures 11A, 11B, 11C:
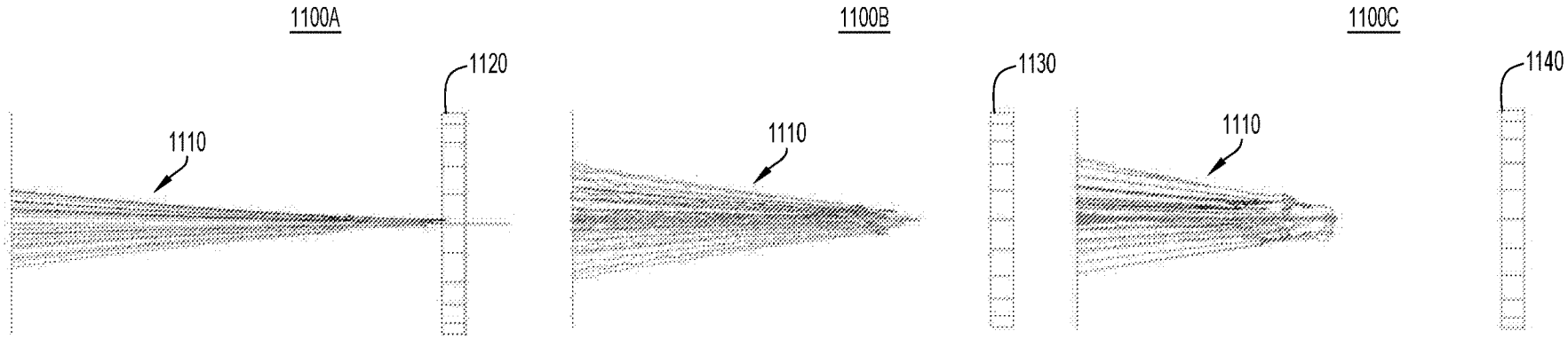
FIGS. 11A-11C are respective side views of yet further simulated trajectories of particles influenced by an apparatus for radiation shielding, in an example embodiment.

FIGS. 11A-11C are respective example elevation views 1100A, 1100B, and 1100C of simulated radiation (e.g., ion vortex) trajectories influenced by an apparatus for radiation shielding. Each view 1100A, 1100B, and 1100C illustrates a planar view of incoming radiation 1110 propagating toward respective magnetic elements 1120, 1130, and 1140. Each magnetic element 1120, 1130, and 1140 is configured to produce a tapered magnetic field. Magnetic element 1120 produces a relatively weak tapered magnetic field, magnetic element 1140 produces a relatively strong tapered magnetic field, and element 1130 produces a tapered magnetic field of a strength between the relatively weak tapered magnetic field and the relatively strong tapered magnetic field. As shown, magnetic element 1120 deflects some but not all of the incoming radiation 1110. Magnetic elements 1130 and 1140 deflect all of the incoming radiation 1110. The distance at which magnetic element 1140 deflects the incoming radiation 1110 is greater than the distance at which magnetic element 1130 deflects the incoming radiation 1110.

Figure 12:
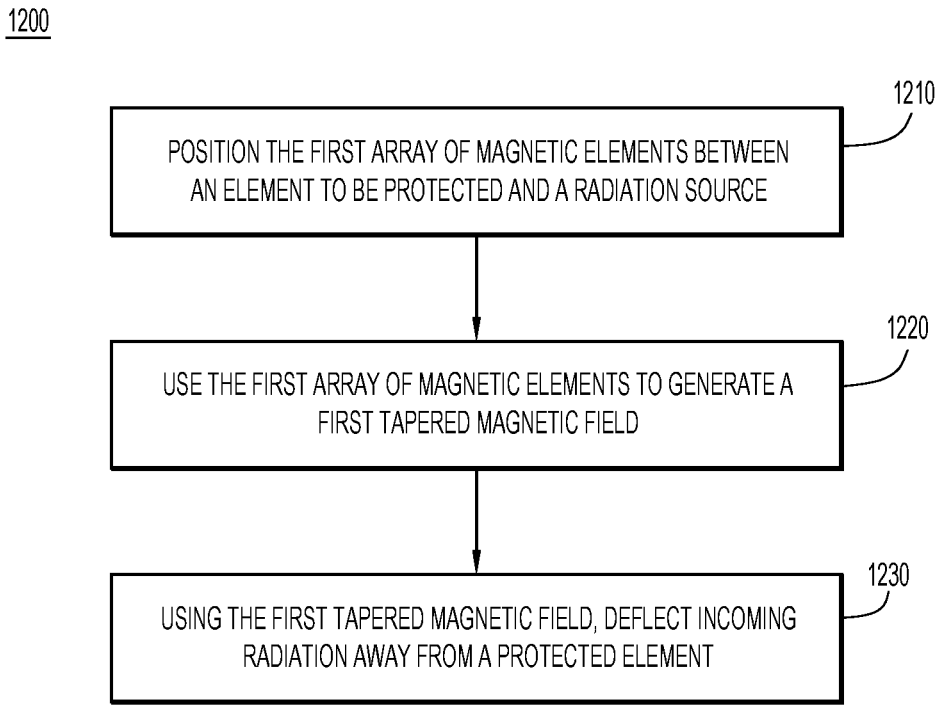
FIG. 12 is a flowchart of a method for radiation shielding, in an example embodiment.

FIG. 12 is a flowchart of an example method 1200 for radiation shielding. Method 1200 may be performed by a radiation shield including a first plurality of magnetic elements arranged in a first array on a first housing element. At 1210, the first array of magnetic elements may be positioned between an element to be protected and a radiation source. At 1220, the first array may be used to generate a first tapered magnetic field. In an example, the first tapered magnetic field may be of increasing size in the direction of the radiation source. At 1230, the first tapered magnetic field may be used to deflect incoming radiation away from the protected element. For example, the tapered magnetic field may exert a magnetic force on the incoming radiation perpendicular to the direction in which the incoming radiation is moving, thereby causing the ion trajectory/velocity to change.

In another embodiment, a second array of magnetic elements may be positioned between the first array of magnetic elements and the element to be protected. In yet another embodiment, a third array of magnetic elements may be positioned between the second array of magnetic elements and the element to be protected. In still another embodiment, the protected element may be positioned within a housing, and at least a first plurality of magnetic elements may be arranged on the housing in a first array configured to generate a first tapered magnetic field of increasing size in a direction away from the housing. In another embodiment, the housing may include a plurality of housing elements, and the method may include arranging a plurality of magnetic elements in an array on each of the housing elements. In an additional embodiment, respective arrays on the plurality of housing elements may generate respective tapered magnetic fields in different directions.

In one form, an apparatus for radiation shielding is provided. The apparatus includes a first housing element and a first plurality of magnetic elements arranged in a first array on the first housing element. The first array is configured to generate a first tapered magnetic field and, using the first tapered magnetic field, deflect incoming radiation away from a protected element.

In one example, the first plurality of magnetic elements includes a first plurality of multipole magnets. The first plurality of multipole magnets may include a first plurality of quadrupole magnets. In a first example, the first plurality of magnetic elements includes a first plurality of magnetic elements having octagonal cross-sections. In a second example, the first plurality of magnetic elements includes a first plurality of C-hairpin-shaped magnets. The first plurality of C-hairpin-shaped magnets may include a first plurality of nested or interlocking C-hairpin-shaped magnets.

In another example, the apparatus further comprises a second housing element and a second plurality of magnetic elements arranged on the second housing element in a second array between the first array and the protected element. The second array is configured to generate a second tapered magnetic field and, using the second tapered magnetic field, deflect the incoming radiation away from the protected element. The first and second arrays may be configured to generate a magnetic bottle to contain the radiation. Furthermore, the first tapered magnetic field may be crossed with the second magnetic field.

The plurality of magnetic elements may include magnets of any suitable type. For example, the magnets may be multipole magnets (e.g., quadrupole, sextupole, octupole, etc.). The magnetic elements may have any suitable shape/cross-section, such as circular, octagonal, C-hairpin-shaped, gradient, cylinder, disk, etc. The magnetic elements may be staged circular hollow magnets, in one example. Furthermore, the plurality of magnet elements may include any suitable magnetic material (e.g., AlNiCo5, Sm2Co17, NdFeB, SrFe12O19, etc.). The plurality of magnetic elements may be permanent or electromagnetic magnets. If electromagnets are used, the tapered magnetic field may be steered in different directions relative to the plane of the array, e.g., using phase array techniques, as opposed to being fixed at a particular angle relative to the plane of the array. The strength(s) of the magnetics may be proportional to the energy of incoming radiation, which may be determined based on the mass, electric charge, and velocity of the incoming radiation. In one example, magnets used in an array on a silicon wafer may each be on a sub-millimeter scale and produce 100 mT local magnetic fields. In another example, permanent magnets (e.g., $Nd_2FE_{14}B$) may be 100 T/m locally across 3 mm.

An array may include any suitable number of magnetic elements. For example, the array may include only one or two magnetic elements. Alternatively, the magnetic elements in a given array may number in the hundreds or thousands. The arrays may be generally circular, ovular, polygonal, any combination of the foregoing, etc. Furthermore, the housing element may comprise a single housing element or multiple housing elements. The housing may be spherical, cylindrical, square, pyramidal, any combination of the foregoing, etc.

One or more features disclosed herein may be implemented in, without limitation, circuitry, a machine, a computer system, a processor and memory, a computer program encoded within a computer-readable medium, and/or combinations thereof. Circuitry may include discrete and/or integrated circuitry, application specific integrated circuitry (ASIC), field programmable gate array (FPGA), a system-on-a-chip (SOC), and combinations thereof.

Methods and systems are disclosed herein with the aid of functional building blocks illustrating functions, features, and relationships thereof. At least some of the boundaries of these functional building blocks have been arbitrarily defined herein for the convenience of the description. Alternate boundaries may be defined so long as the specified functions and relationships thereof are appropriately performed. While various embodiments are disclosed herein, it should be understood that they are presented as examples. The scope of the claims should not be limited by any of the example embodiments disclosed herein.

What has been described above are examples. It is, of course, not possible to describe every conceivable combination of components or methodologies, but one of ordinary skill in the art will recognize that many further combinations and permutations are possible. Accordingly, the disclosure is intended to embrace all such alterations, modifications, and variations that fall within the scope of this application, including the appended claims. As used herein, the term "includes" means includes but not limited to, the term "including" means including but not limited to. The term "based on" means based at least in part on. Additionally, where the disclosure or claims recite "a," "an," "a first," or "another" element, or the equivalent thereof, it should be interpreted to include one or more than one such element, neither requiring nor excluding two or more such elements.

What is claimed is:

1. An apparatus for radiation shielding, comprising:
a first housing element; and
a first plurality of magnetic elements arranged in a first array on the first housing element, wherein the first array is configured to:
generate a first tapered magnetic field; and
using the first tapered magnetic field, deflect incoming charged radiation away from a protected element.

2. The apparatus of claim 1, wherein the first plurality of magnetic elements includes a first plurality of multipole magnets.

3. The apparatus of claim 2, wherein the first plurality of multipole magnets includes a first plurality of quadrupole magnets.

4. The apparatus of claim 1, wherein the first plurality of magnetic elements includes a first plurality of magnetic elements having octagonal cross-sections.

5. The apparatus of claim 1, wherein the first plurality of magnetic elements includes a first plurality of C-hairpin-shaped magnets.

6. The apparatus of claim 5, wherein the first plurality of C-hairpin-shaped magnets includes a first plurality of nested C-hairpin-shaped magnets.

7. The apparatus of claim 5, wherein the first plurality of C-hairpin-shaped magnets includes a first plurality of interlocking C-hairpin-shaped magnets.

8. The apparatus of claim 1, further comprising:
a second housing element; and
a second plurality of magnetic elements arranged on the second housing element in a second array between the first array and the protected element, wherein the second array is configured to:
generate a second tapered magnetic field; and
using the second tapered magnetic field, deflect the incoming charged radiation away from the protected element.

9. The apparatus of claim 8, wherein the first and second arrays are configured to generate a magnetic bottle to contain the incoming charged radiation.

10. The apparatus of claim 8, wherein the first tapered magnetic field is crossed with the second tapered magnetic field.

11. An apparatus for radiation shielding, comprising:
a first housing element;
a first plurality of magnetic elements arranged in a first array on the first housing element;
a second housing element;
a second plurality of magnetic elements arranged in a second array on the second housing element between the first array and a protected element;
a third housing element;
a third plurality of magnetic elements arranged in a third array on the third housing element between the second array and the protected element, wherein:
the first array is configured to:
generate a first tapered magnetic field; and
using the first tapered magnetic field, deflect incoming charged radiation away from the protected element;
the second array is configured to:
generate a second tapered magnetic field, wherein the first tapered magnetic field is crossed with the second tapered magnetic field; and
using the second tapered magnetic field, deflect the incoming charged radiation away from the protected element; and
the third array is configured to:
generate a third tapered magnetic field; and
using the third tapered magnetic field, deflect the incoming charged radiation away from the protected element.

12. The apparatus of claim 11, wherein the second and third arrays are configured to generate a magnetic bottle to contain the incoming charged radiation.

13. The apparatus of claim 11, wherein the first plurality of magnetic elements includes a first plurality of multipole magnets.

14. The apparatus of claim 13, wherein the first plurality of multipole magnets includes a first plurality of quadrupole magnets.

15. The apparatus of claim 11, wherein the first plurality of magnetic elements includes a first plurality of magnetic elements having octagonal cross-sections.

16. The apparatus of claim 11, wherein the first plurality of magnetic elements includes a first plurality of C-hairpin-shaped magnets.

17. An apparatus for radiation shielding, comprising:
a first housing element; and
a first plurality of quadrupole magnets having octagonal cross-sections, wherein the first plurality of quadrupole magnets are arranged on the first housing element in a first array, and wherein the first array is configured to:
generate a first tapered magnetic field; and
using the first tapered magnetic field, deflect incoming charged radiation away from a protected element.

18. The apparatus of claim 17, further comprising:

a second housing element; and a second plurality of quadrupole magnets having octagonal cross-sections, wherein the second plurality of quadrupole magnets are arranged on the second housing element in a second array disposed between the first array and the protected element, wherein the second array is configured to:

generate a second tapered magnetic field; and using the second tapered magnetic field, deflect the incoming charged radiation away from the protected element.

19. The apparatus of claim 18, wherein the first and second arrays are configured to generate a magnetic bottle to contain the incoming charged radiation.

20. The apparatus of claim 18, wherein the first tapered magnetic field is crossed with the second tapered magnetic field.

* * * * *